US006442817B1

(12) United States Patent
Swanson

(10) Patent No.: US 6,442,817 B1
(45) Date of Patent: Sep. 3, 2002

(54) TOOL FOR REPLACING BRAKE CAMSHAFT BUSHING IN SUSPENSION CHASSIS

(76) Inventor: Richard C. Swanson, 5 Colony Dr., Orchard Park, NY (US) 14127

( * ) Notice: Subject to any disclaimer, the term of this patent is extended or adjusted under 35 U.S.C. 154(b) by 0 days.

(21) Appl. No.: 09/710,072

(22) Filed: Nov. 10, 2000

(51) Int. Cl.[7] ..... B25B 27/14
(52) U.S. Cl. ..... 29/275
(58) Field of Search ..... 29/275, 255, 263, 29/282, 280

(56) References Cited

U.S. PATENT DOCUMENTS 1,759,285 A * 5/1930 Sease ..... 29/275
3,083,449 A * 4/1963 Simmons ..... 29/275

* cited by examiner

*Primary Examiner*—Robert C. Watson
(74) *Attorney, Agent, or Firm*—Hodgson Russ LLP

(57) ABSTRACT

A specialized tool for replacing brake camshaft bushings in suspension chassis is disclosed. The tool is modular in construction and comprises a universal handle, a detent limiting depth of tool insertion into a chassis bore, a push ring for engaging an end of the camshaft bushing, and a bushing carrier respectively connected in sequence by a threaded fastener extending through axially aligned through-holes in the bushing carrier, push ring, and detent for mating with a tapped hole in the handle. A plurality of interchangeable push rings of different sizes and a plurality of interchangeable bushing carriers of different sizes enable the tool to accommodate camshaft bushings of different sizes.

6 Claims, 3 Drawing Sheets

TOOL FOR REPLACING BRAKE CAMSHAFT BUSHING IN SUSPENSION CHASSIS

BACKGROUND OF THE INVENTION

1. Field of the Invention

The present invention relates generally to specialized tools for performing vehicle maintenance, and more particularly to an improved modular tool for replacing a brake camshaft bushing seated within a bore in a suspension chassis of a truck or other vehicle.

2. Description of the Related Art

Attention is directed initially to FIG. 1 for an explanation of the relevant prior art. Heretofore, the task of inserting a camshaft bushing 6 housed within a bore 4 in a suspension chassis 2 has commonly been performed using a tool 10. Tool 10 is formed from a solid length of round steel bar stock and includes a handle portion 12, a proximal end 14, and a radial step 16 for transition to a radially reduced portion 18. The diameter of radially reduced portion 18 is sized for axially slidable fit within camshaft bushing 6, while the diameter of handle portion 12 is undersized relative to the diameter of chassis bore 4. In a typical replacement procedure according to the prior art, a mechanic pries the existing grease seals 8A, 8B out of chassis bore 4 using a screwdriver or similar tool, inserts reduced portion 18 of tool 10 into camshaft bushing 6 until an end of the camshaft bushing is engaged by radial step 16, and then drives the tool 10 by striking proximal end 14 with a hammer to push camshaft bushing 6 out the opposite end of the chassis bore. It is also possible for the mechanic to push the backside grease seal 8B out along with camshaft bushing 6 using tool 10. Insertion of a new camshaft bushing 6 into chassis bore 4 is performed by sliding the camshaft bushing onto radially reduced portion 18 of tool 10, driving tool 10 with camshaft bushing 6 axially into the bore by striking proximal end 14 with a hammer until the camshaft bushing is at a suitable depth allowing space in the bore for greases seals 8A, 8B, and then hammering the grease seals in place in the bore.

Certain drawbacks of this prior art methodology can be attributed to tool 10. First, it is necessary for a service station to absorb the expense of owning six or more tools 10 of different sizes to accommodate the common camshaft bushing sizes known in the industry. Second, tool 10 does not limit or control the depth to which camshaft bushing 6 is inserted into the bore, leaving this to the skill of the mechanic. Third, tool 10 does not install grease seals 8A, 8B, and the mechanic must perform the additional operation of hammering the grease seals into the bore. This operation can prove frustrating and imprecise, since the greases seals tend to flip or rotate back and forth in the bore with each off-center hammer blow. Fourth, the design of tool 10 is inherently massive since handle portion 12 is radially larger than reduced portion 18, thereby offering significant resistance to the transfer of driving force from a hammer to the camshaft bushing 6. Fifth, the unitary construction of tool 10 necessitates replacement of the entire tool even if only a portion of the tool is damaged.

BRIEF SUMMARY OF THE INVENTION

Therefore, it is an object of the present invention to provide an improved tool for replacing a brake camshaft bushing in a suspension chassis that is capable of performing both removal and installation functions with respect to the camshaft bushing and associated grease seals.

It is another object of the present invention to provide an improved tool for replacing brake camshaft bushings of different sizes, thereby eliminating the need to purchase a set of differently sized tools.

It is another object of the present invention to provide an improved tool for replacing brake camshaft bushings that is less massive than tools of the prior art for better transfer of driving forces.

It is another object of the present invention to provide an improved tool for replacing brake camshaft bushings that includes removable parts that are less expensive to replace than an entire tool of the prior art in cases of wear or damage.

It is a further object of the present invention to provide an improved tool for replacing brake camshaft bushings that is modular in design for realizing the objects stated above.

In view of these and other objects, a modular tool formed in accordance with a preferred embodiment of the present invention includes a handle, a detent, a push ring, and a bushing carrier respectively connected in sequence by a threaded fastener extending through axially aligned through-holes in the bushing carrier, push ring, and detent for mating with a tapped hole in the handle. The detent is preferably a washer that is oversized relative to the chassis bore to limit insertion of the tool. The push ring is preferably a smaller washer having an outside diameter that allows the push ring to engage an annular end of the camshaft bushing without extending beyond the outside diameter of the camshaft bushing. The bushing carrier is a cylindrical component sized for slidably receiving the camshaft bushing thereon. Accordingly, a plurality of push rings and bushing carriers of different sizes can be provided along with the handle and the detent to accommodate different standard bushing sizes.

The tool is configured without the detent for driving an existing camshaft bushing and grease seals out of the chassis bore by striking an end of the handle with a hammer. The tool is configured with the detent for installing a new camshaft bushing and grease seals mounted on the bushing carrier, whereby the push ring sets the camshaft bushing and a distal grease seal at a proper depth in the bore and the detent applies evenly distributed pressure to a proximal grease seal to be flush with an end of the bore when the handle is struck with a hammer.

BRIEF DESCRIPTION OF THE SEVERAL VIEWS OF THE DRAWINGS

The nature and mode of operation of the present invention will now be more fully described in the following detailed description of the preferred embodiments taken with the accompanying drawing figures, in which.

DETAILED DESCRIPTION OF THE PREFERRED EMBODIMENTS

Figure 1:
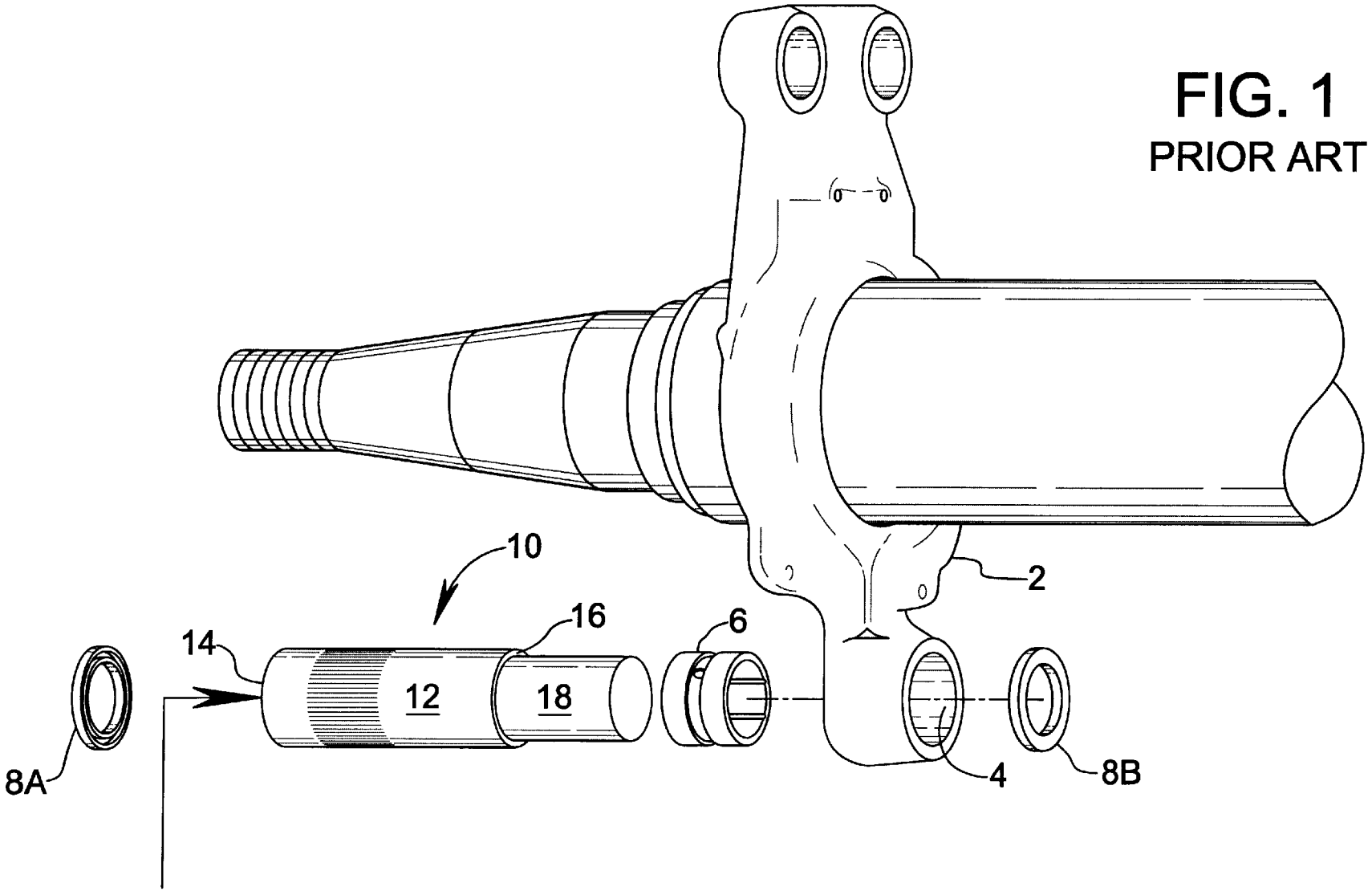
FIG. 1 PRIOR ART
FIG. 1 is a perspective view showing a prior art tool for replacing a camshaft bushing and the environment in which the prior art tool is used.
Figure 2:
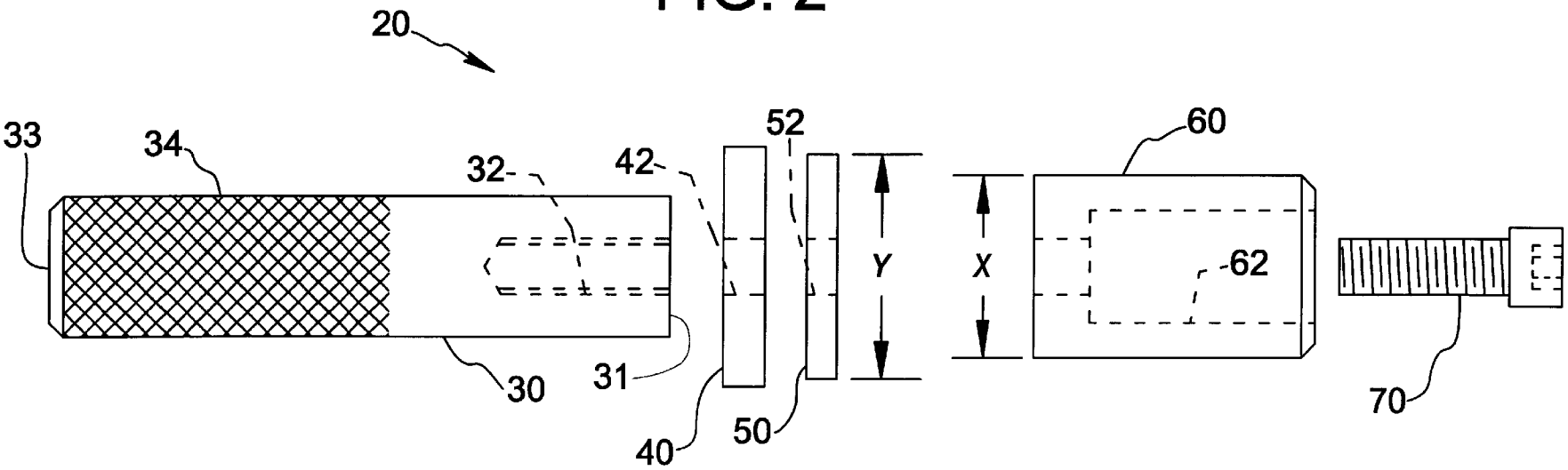
FIG. 2 is an exploded side view of a tool formed in accordance with a preferred embodiment of the present invention for replacing a camshaft bushing.

Attention is now directed to FIGS. 2 and 3 of the drawings, wherein a tool formed in accordance with a preferred embodiment of the present invention is shown and designated generally by the reference numeral 20. Tool 20 comprises a handle 30, a detent 40 located at a distal end 31 of the handle, a push ring 50 adjacent detent 40, and a cylindrical bushing carrier 60 adjacent push ring 50.

As can be seen in the exploded view of FIG. 2, tool 20 is preferably modular in construction, such that handle 30, detent 40, push ring 50, and bushing carrier 60 are separable constituent parts of tool 20. More specifically, handle 30 is provided with an axially extending tapped hole 32 opening through distal end 31, and the remaining parts—namely detent 40, push ring 50, and bushing carrier 60—include respective axial through-holes 42, 52, and 62 through which a socket head cap screw 70 or other suitable fastener extends to mate with tapped hole 32, thereby removably connecting constituent parts 40, 50 and 60 to handle 30. While this completely modular construction is preferred for reasons given below, it is understood that tool 20 can be made as a unitary construction, for example by turning the outer diameter of a cylindrical length of stock material on a lathe to form handle 30, detent 40, push ring 50, and bushing carrier 60. Alternatively, varying degrees of modularity are possible. As a first example, tool 20 could be made such that only bushing carrier 60 is removably connected to handle 30, while detent 40 and push ring 50 are permanently connected or integrally formed with handle 30. As a second example, tool 20 could be made such that both bushing carrier 60 and push ring 50 are removably connected to handle 30, while detent 40 is permanently connected or integrally formed with handle 30. However, it is noted that if detent 40 is permanently fixed to handle 30, the usefulness of tool 20 is limited to insertion of a new camshaft bushing and grease seals and does not include the capability of removing an existing camshaft bushing and grease seals from within chassis bore 4.

Each of the constituent parts of tool 20 will now be described in detail, beginning with handle 30. Handle 30 preferably comprises a cylindrical metal bar having a chamfered proximal end 33 opposite distal end 31. The length and diameter of handle 30 are sized for gripping by a user, and an outer surface portion 34 of the handle is preferably knurled to reduce slippage. In a currently favored design, handle 30 is 5.5" in length and 1.25" in diameter. As mentioned, handle 30 includes tapped hole 32 that extends along a central axis of the handle, beginning at distal end 31 and continuing to a depth suitable for tight connection of constituent parts 40, 50, and 60 by fastener 70. In the currently preferred design, tapped hole 32 is a ½–13 threaded hole that reaches a depth of 1.25" from distal end 31.

Detent 40 of the preferred embodiment is in the form of a round washer having central through-hole 42. Detent 40 functions to limit the depth of insertion of tool 20 within chassis bore 4 and to force an adjacent grease seal into the bore, and thus it is of critical importance that the outside diameter of detent 40 be oversized relative to the inner diameter of the chassis bore. Since chassis bores typically range from 1.4375" to 2.0" inches in diameter, a preferred outside diameter for detent 40 is 2.125" inches. The inside diameter of detent 40 corresponding to through-hole 42 is 0.5" to match the diameter of tapped hole 32. A suitable axial length (thickness) of detent 40 is 0.375".

Push ring 50 is also in the form of a round washer, and includes central through-hole 52. As will be explained further below, push ring functions to push an existing camshaft bushing and grease seals from within chassis bore 4 and push a new camshaft bushing and second grease seal into the chassis bore. Therefore, the outside diameter Y of push ring 50 should be no greater than the diameter of the chassis bore and outside diameter of the camshaft bushing, and preferably just slightly less than the bore diameter to allow some clearance for insertion. However, the outside diameter of the push ring must be greater than the inside diameter of the camshaft bushing so that it can push the camshaft bushing in end-to-end abutment. Best performance in pushing is achieved where the push ring outside diameter Y is nominally equal to the outside diameter of the bushing being pushed. With these criteria, it is possible to have a plurality of push rings 50 having different outside diameters Y suitable for typical camshaft bushings and bore diameters. The table below provides outside diameter specifications of push rings matched for use with six common sizes of camshaft bushings used in trucks, trailers, and tractors:

| BUSHING SIZE | PUSH RING OD "Y" |
|---|---|
| 1.25" ID, 1.625" OD | 1.625" |
| 1.25" ID, 1.875" OD | 1.875" |
| 1.50" ID, 1.625" OD | 1.625" |
| 1.50" ID, 1.6875" OD | 1.625" |
| 1.50" ID, 1.875" OD | 1.875" |
| 1.625" ID, 2.00" OD | 2.00" |

Consequently, a set of three push rings having respective outside diameters Y of 1.625", 1.875", and 2.00" is preferably provided for improving the versatility of tool 20. Similar to detent 40, the inside diameter of push ring 50 defined by through-hole 52 is 0.5" to match the diameter of tapped hole 32. The axial length (thickness) of push ring 50 controls the depth of insertion of camshaft bushing 6 into bore 4, and is preferably 0.270".

The last part connected to handle 30 is bushing carrier 60, which is in the form of a cylinder having an outside diameter X that corresponds to an inside diameter of an associated camshaft bushing for slidably receiving the bushing thereon. Accordingly, several bushing carriers each having a different X dimension can be provided for selective incorporation as part of tool 20 depending upon the inside diameter of the particular camshaft bushing to be installed or replaced. Accordingly, with reference to the table presented above, a set of three bushing carriers having respective outside diameters X of 1.25", 1.50", and 1.625" is preferably supplied for versatility of tool 20. The other dimensions of bushing carrier 60, namely the length and inner dimensions of through-hole 62, can be held constant. In particular, a suitable length for bushing carrier 60 is 2.50", which is sufficient to extend beyond the longest camshaft bushings in common use. Through-hole 62 is preferably a stepped hole for permitting access to the head of fastener 70. In the preferred embodiment shown in FIG. 2, the diameter of through-hole 62 matches the diameter of tapped hole near proximal end 61 of bushing carrier 60 positioned adjacent push ring 50. The inside diameter of through hole 62 increases at a radial step 65 to a preferred diameter of 1.00", which provides a clamping surface for the head of fastener 70 and can be the same regardless of the outside diameter X of the bushing carrier. The axial position of step 65 is chosen close to proximal end 61, for example 0.5" therefrom, to avoid use of an unnecessarily long fastener.

The parts 30, 40, 50, and 60 described above are preferably formed of 4140 alloy steel heated treated to 38–40 Rockwell C hardness for tool durability, although other materials and or treatments can be used without straying from the present invention.

Handle 30 and bushing carrier 60 are typically machined from round bar stock, detent 40 and push ring 50 can be machined or purchased as "off the shelf" items, and fastener 70 is an off the shelf item, preferably a ½–13 by 1.5" long socket head cap screw.

The manner of assembling and using tool 20 will now be described. Tool 20 is first assembled without detent 40 for use in removing an existing camshaft bushing and grease seals. The first step in such assembly is to choose a suitably sized push ring 50 and a suitably sized bushing carrier 60 depending upon the dimensions of the camshaft bushing involved in accordance with the criteria discussed above. The next step is to arrange handle 30, push ring 50, and bushing carrier 60 in sequence and coaxially align the through-holes 52, and 62 with tapped hole 32 in handle 30. Finally, fastener 70 is inserted successively within through-holes 62 and 52, and then tightened in threaded mating with tapped hole 32 to form the tool as shown in FIG. 3A.

Figure 3A:
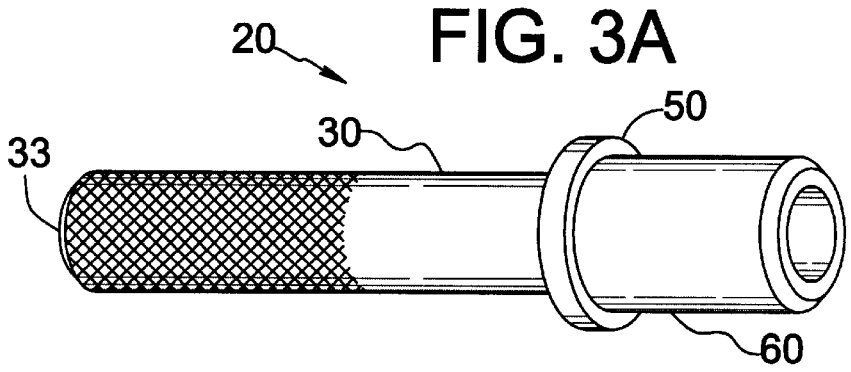
FIG. 3A is a perspective view of the tool shown in FIG. 2 configured for removing an existing camshaft bushing and grease seals from within a chassis bore.
Figure 3B:
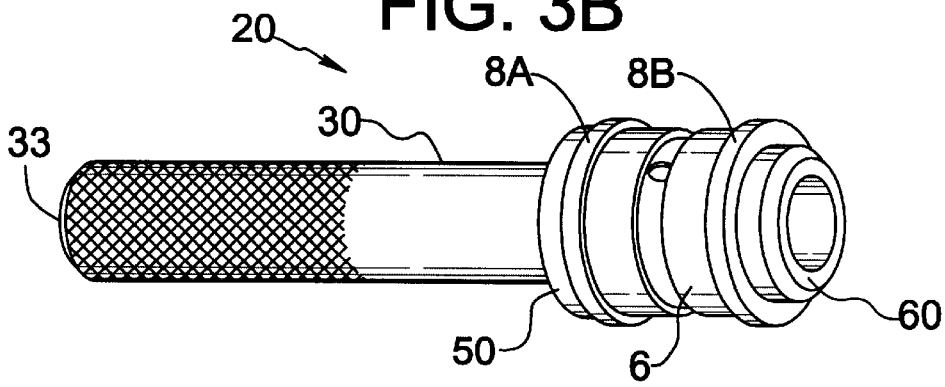
FIG. 3B is a perspective view similar to that of FIG. 3A, however also showing the camshaft bushing and grease seals.

Tool 20, as assembled according to FIG. 3A, is used to remove an existing camshaft bushing 6 and grease seals 8A, 8B from within chassis bore 4 in the following manner. The user holds handle 30, aligns bushing carrier 60 coaxially with the camshaft bushing and grease seals, and drives the tool 20 by striking a hammer upon proximal end 33 of handle 30. This serves to mount the camshaft bushing 6 and grease seals 8A, 8B on bushing carrier 60, as shown in FIG. 3B and push these parts out an opposite end of bore 4. Since detent 40 was omitted from tool 20 during assembly, insertion of tool 20 within bore 4 is not limited and the tool is sized to drive out the camshaft bushing and grease seals from the bore.

Tool 20 can also be assembled to perform installation of a new camshaft bushing and grease seals within an empty chassis bore. Assembly is essentially the same as described above in connection with FIG. 3A, except that detent 40 is positioned between handle 30 and push ring 50. Accordingly, tool 20 appears as shown in FIG. 4A.

Figure 4A:
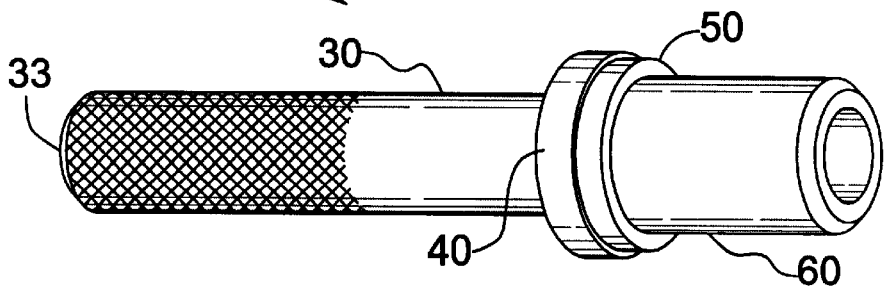
FIG. 4A is a perspective view of the tool shown in FIG. 2 configured for installing a new camshaft bushing and grease seals within a chassis bore.
Figure 4B:
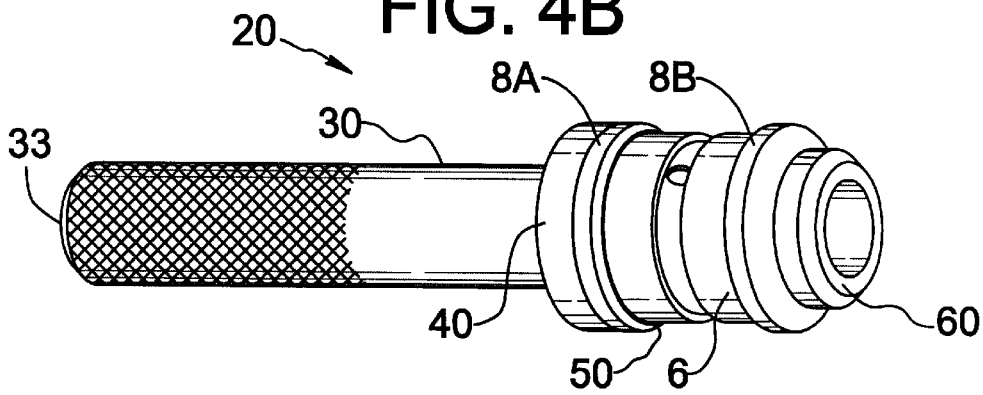
FIG. 4B is a perspective view similar to that of FIG. 4A, however also showing the camshaft bushing and grease seals.

Tool 20, assembled as shown in FIG. 4A, is used to install a camshaft bushing 6 and grease seals 8A, 8B within chassis bore 4 in the following manner. The user successively slides first grease seal 8A, new camshaft bushing 6, and second grease seal 8B onto bushing carrier 60 such that first grease seal 8A is in abutment with detent 40 and camshaft bushing 6 is in abutment with push ring 50. The user holds handle 30, aligns bushing carrier 60 coaxially with chassis bore 4, and drives the tool 20 by striking a hammer upon proximal end 33 of handle 30 until detent 40 engages the chassis casting to prevent further insertion. Detent 40 not only prevents further assertion of tool 20 within the bore, but also applies even pressure about the entire circumference of grease seal 8A. Push ring 50 forces camshaft bushing 6 and grease seal 8B to a predetermined depth dictated by the thickness push ring 50. Consequently, grease seals 8A, 8B and camshaft 10 bushing 6 are evenly seated within the chassis bore. The user then pulls tool 20 out, leaving the camshaft bushing and grease seals in place within chassis bore 4.

Several advantages of the present invention over the prior art are readily apparent. The insertion operation is faster and more precise because the grease seals do not have to be separately hammered into place. The modular design of the preferred embodiment allows a common handle 30, which is the heaviest part of tool 20, to be used for variety of differently sized camshaft bushings. Thus, the requirement of six separate tools of different sizes is overcome by the modular design, and replacement parts can be obtained in case of damage or defect rather than replacing the entire tool. Because handle 30 does not include a radial step serving as a push ring as in the prior art, handle 30 can be reduced in diameter relative to the prior art construction to decrease the overall mass of tool 20 and improve transfer of drive force to the grease seals and camshaft bushing.

What is claimed is:

1. A tool for inserting a camshaft bushing and grease seals into a bore in a suspension chassis, said tool comprising:

a handle;

a detent at a distal end of said handle and removably connected to said handle, said detent being oversized to prevent insertion thereof within said bore;

a push ring adjacent said detent and removably connected to said handle, said push ring having an outside diameter greater than an inside diameter of said bushing but no greater than a diameter of said bore; and a cylindrical bushing carrier adjacent said push ring and removably connected to said handle, said bushing carrier having an outside diameter corresponding to said inside diameter of said bushing to slidably receive said bushing thereon and said grease seals;

wherein said handle includes a tapped hole opening through said distal end thereof and said detent, said push ring, and said bushing carrier are removably connected to said handle by a fastener threadably mating in said tapped hole;

whereby said tool can be adapted for removing an existing camshaft bushing and grease seals from said bore by omitting said detent from said tool.

2. The tool according to claim 1, wherein said push ring is a washer.

3. The tool according to claim 1, wherein said detent is a washer having an outer diameter greater than said diameter of said bore.

4. A tool for removing a camshaft bushing and grease seals from a bore in a suspension chassis, said tool comprising:

a handle;

a push ring adjacent said handle and removably connected to said handle, said push ring having an outside diameter greater than an inside diameter of said bushing but no greater than a diameter of said bore; and a cylindrical bushing carrier adjacent said push ring and removably connected to said handle, said bushing carrier having an outside diameter corresponding to said inside diameter of said bushing to slidably receive said bushing and said grease seals thereon;

wherein said handle includes a tapped hole opening through said distal end thereof and said push ring and said bushing carrier are removably connected to said handle by a fastener threadably mating in said tapped hole.

5. The tool according to claim 4, wherein said push ring is a washer.

6. A modular tool for replacing differently sized camshaft bushings within differently sized bores in suspension chassis, said tool comprising:

a handle having an axially extending tapped hole opening through a distal end thereof;

an annular detent member having an axial through-hole and an outer diameter greater than a diameter of a maximum bore diameter of said differently sized bores to prevent insertion thereof within any of said differently sized bores;

a plurality of push rings each having an axial through-hole and an outside diameter greater than an inside diameter of a corresponding bushing but less than a diameter of a corresponding bore;

a plurality of cylindrical bushing carriers each having an axial through hole and an outer diameter sized for allowing said bushing carrier to slidably receive a corresponding bushing; and a bolt threadably mating with said tapped hole and sized to extend through said axial through-holes in said detent member, said plurality of push rings, and said plurality of bushing carriers;

whereby said detent member, a chosen one of said plurality of push rings, and a chosen one of said plurality of bushing carriers is removably connected to said handle.

* * * * *